US006055967A

United States Patent [19]

Miyagi et al.

[11] Patent Number: 6,055,967

[45] Date of Patent: May 2, 2000

[54] SCREW SUPERCHARGER FOR VEHICLE

[75] Inventors: Yoshiyuki Miyagi, Ichikawa; Shigeru Takabe, Sagamihara, both of Japan

[73] Assignee: Ishikawajima-Harima Heavy Industries Co., Ltd., Tokyo, Japan

[21] Appl. No.: 09/073,397

[22] Filed: May 5, 1998

[30] Foreign Application Priority Data

May 16, 1997 [JP] Japan ..... 9-127371

[51] Int. Cl.[7] ..... F02B 33/00

[52] U.S. Cl. ..... 123/564

[58] Field of Search ..... 123/564

[56] References Cited

U.S. PATENT DOCUMENTS

| | | |
|---|---|---|
| 4,498,849 | 2/1985 | Schibbye et al. . |
| 5,090,392 | 2/1992 | Nakano et al. . |
| 5,127,386 | 7/1992 | Sowards . |

FOREIGN PATENT DOCUMENTS

| | | |
|---|---|---|
| 61-083483 | 4/1986 | Japan . |
| 62-199926 | 9/1987 | Japan . |
| 3-037326 | 2/1991 | Japan . |
| 3-117693 | 5/1991 | Japan . |
| 3-294625 | 12/1991 | Japan . |
| 7-233730 | 9/1995 | Japan . |
| 8-14054 | 1/1996 | Japan . |

*Primary Examiner*—Noah P. Kamen
*Attorney, Agent, or Firm*—McCormick, Paulding & Huber LLP

[57] ABSTRACT

A supercharger arrangement for a vehicle engine equipped with a screw supercharger. A bypass pipe extends from a main body of the screw supercharger to an upstream intake air pipe such that part of the intake air compressed to a certain extent in the supercharger returns to an inlet of the supercharger. A duty solenoid valve is connected to the bypass pipe for controlling a flow rate of the air returning to the inlet of the supercharger through the bypass pipe. The screw supercharger is originally designed to match a low speed condition and to feed an excessive amount of air at a high speed condition. The solenoid valve allows the intake air to return to the upstream intake air pipe through the bypass pipe from the supercharger when the engine is operated at a high speed condition so that an excessive amount of air is not supplied to the engine.

36 Claims, 5 Drawing Sheets

SCREW SUPERCHARGER FOR VEHICLE

BACKGROUND OF THE INVENTION

1. Technical Field

The present invention relates to a screw supercharger connected to an intake air pipe of an engine of an automobile or the like.

2. Background Art

In recent years, positive displacement screw superchargers are commonly used for automobiles.

The screw supercharger generally includes a male screw rotor and a female screw rotor engaged with each other, and these rotors are rotated by an engine to compress an intake air to be supplied to the engine.

When the engine does not need a compressed air (e.g., during a partial load condition in a particular transitional period from an idling condition to a constant speed condition) or when the supercharger is designed to suit for low speed condition but the engine is operated at a high speed condition, an excessive amount of air is supplied to the engine from the supercharger. If an excessive amount of air is supplied to the engine, a pressure ratio is raised and knocking likely occurs. Further, it causes lost motion or wasted work. Therefore, a flow rate of air to be supplied to the engine should be controlled.

Generally, a screw compressor for industrial use has a slide valve mechanism to adjust the flow rate of the supercharged air. However, the slide valve mechanism has a complicated structure and is expensive. In addition, the slide valve mechanism is not suited for a vehicle since a running condition of the vehicle changes significantly and quickly but the response of the slide valve is not prompt enough. Furthermore, it is difficult to insure decent longevity of sliding parts and associated parts of the valve mechanism.

In view of the above drawbacks, there is a proposal to provide a bypass line for returning the compressed air to the inlet of the screw supercharger from the exit of the screw supercharger. However, the air discharged from the supercharger has a high pressure and a high temperature. Thus, if the compressed air expelled from the exit of the supercharger is recirculated to the inlet of the supercharger, the air temperature at the supercharger inlet and in turn supercharger exit are accumulatedly raised by this recirculation. In this case, a certain measure should be taken to prevent knocking. For example, an intercooler should be provided or a compression ratio of the engine should be lowered.

However, providing the intercooler raises a manufacturing cost of the supercharger arrangement, and lowering the compression ratio of the engine results in deterioration of the engine performance.

SUMMARY OF THE INVENTION

One object of the present invention is to propose a screw supercharger for an automobile engine, which can easily adjust a flow rate of compressed air to be supplied to the engine.

According to one aspect of the present invention, there is provided a supercharger arrangement for a vehicle engine comprising a screw supercharger connected to an intake air pipe, a bypass pipe extending from a body of the screw supercharger to an upstream segment of the intake air pipe such that part of the intake air compressed to a certain extent in the supercharger returns to an inlet of the supercharger, and a duty solenoid valve connected to the bypass pipe for controlling a flow rate of the air returning to the inlet of the supercharger through the bypass pipe.

This structure is simple, has a long life and reduces a manufacturing cost.

Controlling the air flow rate using the duty solenoid valve enables a delicate air flow rate control since the duty solenoid valve is controllable by an electric signal and/or frequency adjustment. This also contributes to manufacturing cost reduction.

The air pressure inside the screw compressor increases from its inlet to outlet. The bypass pipe extends from that position of the supercharger which can extract an air having a pressure higher than an intake air. If the air of negative pressure is extracted from the supercharger (or if the pressure of the air to be recirculated to the intake air pipe is lower than the pressure of the air flowing in the intake air pipe), it is not possible to cause this air to flow into the intake air pipe. However, it should also be noted that if the air recirculated to the intake air pipe from the supercharger has a considerably high pressure, this high pressure air raises the supercharger inlet and exit pressures and temperatures and causes the same problem as the conventional arrangement has. Therefore, the pressure of the air which is forced to return to the inlet of the supercharger should have a particular range of pressure: it should not be too low and too high. The bypass pipe extends from the supercharger at a position which only allows a compressed air having a moderate pressure to be recirculated to the inlet of the supercharger. It is preferred that the bypass pipe extends from the supercharger body such that the air which has a slightly higher pressure than the intake air flowing in the intake air pipe is returned to the intake air pipe. If the recirculated air has a pressure slightly higher than the air flowing in the intake air pipe, the recirculated air does not raise the air temperature at the supercharger exit significantly. Of course, the air temperature at the supercharger inlet is not raised, either. Therefore, the engine does not need an intercooler and it is unnecessary to lower a compression ratio of the engine.

The supercharger may be designed to suit for a low speed condition. In this setting, an excessive amount of air tends to be supplied to the engine from the supercharger when the engine revolution speed is raised. In this invention, however, the bypass pipe can reduce an amount of air to be supplied to the engine from the supercharger by recirculating part of the intake air to the inlet of the supercharger. Therefore, an appropriate amount of air is also supplied to the engine when the engine is operated at a high speed. In addition, since the supercharger is originally designed to supply a possibly maximum amount of compressed air to the engine without causing knocking when the engine revolution speed is low and the supercharger performance is intentionally deteriorated not to supply a maximum amount of air when the engine revolution speed is raised, an engine torque curve draws a relatively flat curve.

BRIEF DESCRIPTION OF THE ACCOMPANYING DRAWINGS

Figure 3A:
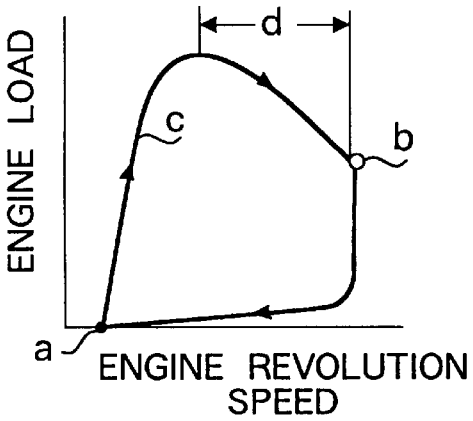
Figure 3B:
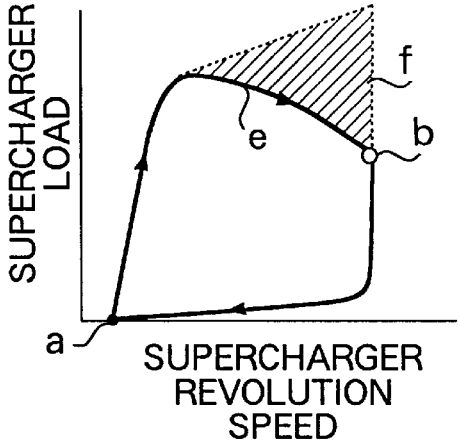
Figure 3C:
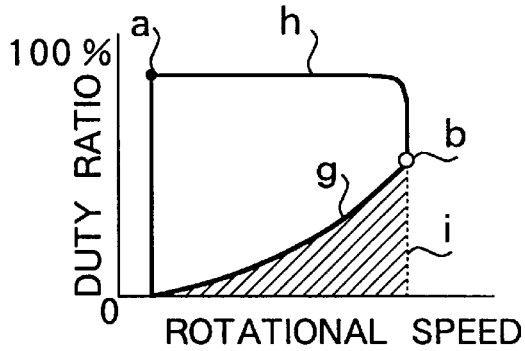
Figure 4A:
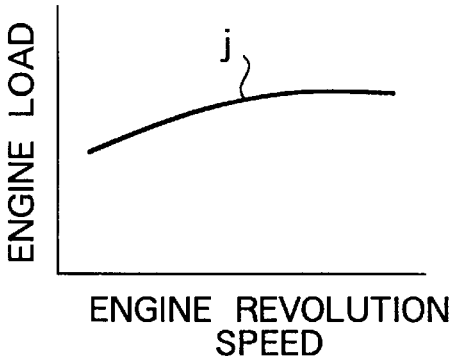
Figure 4B:
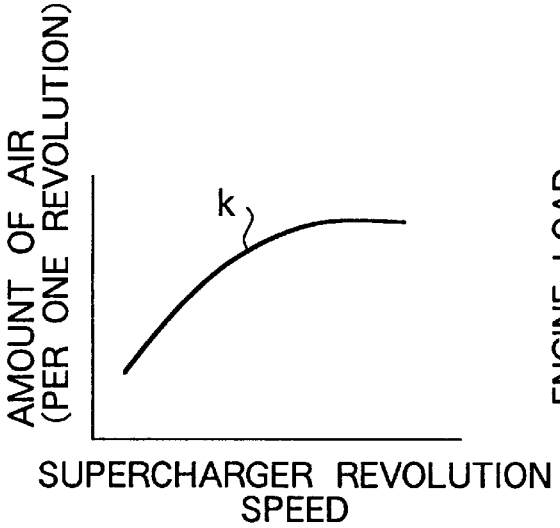
Figure 4C:
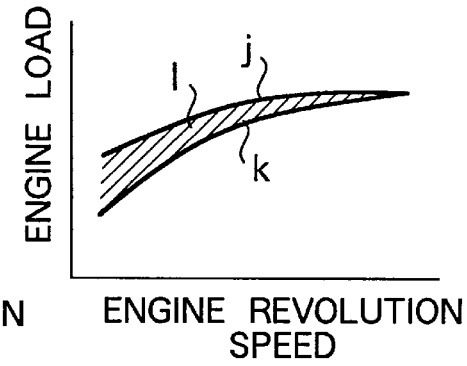
Figure 4D:
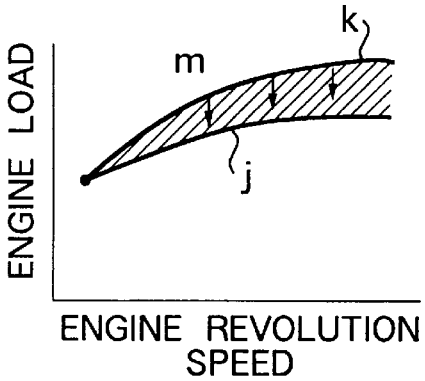
Figure 5:
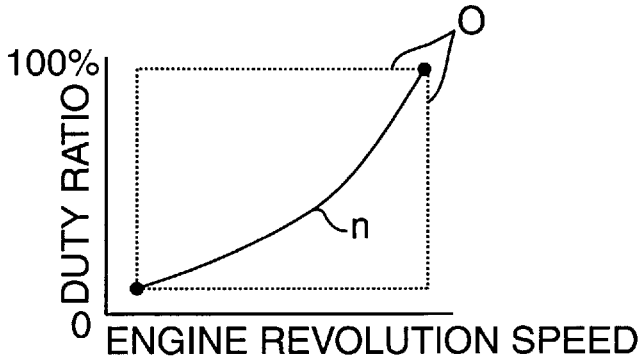
Figure 7:
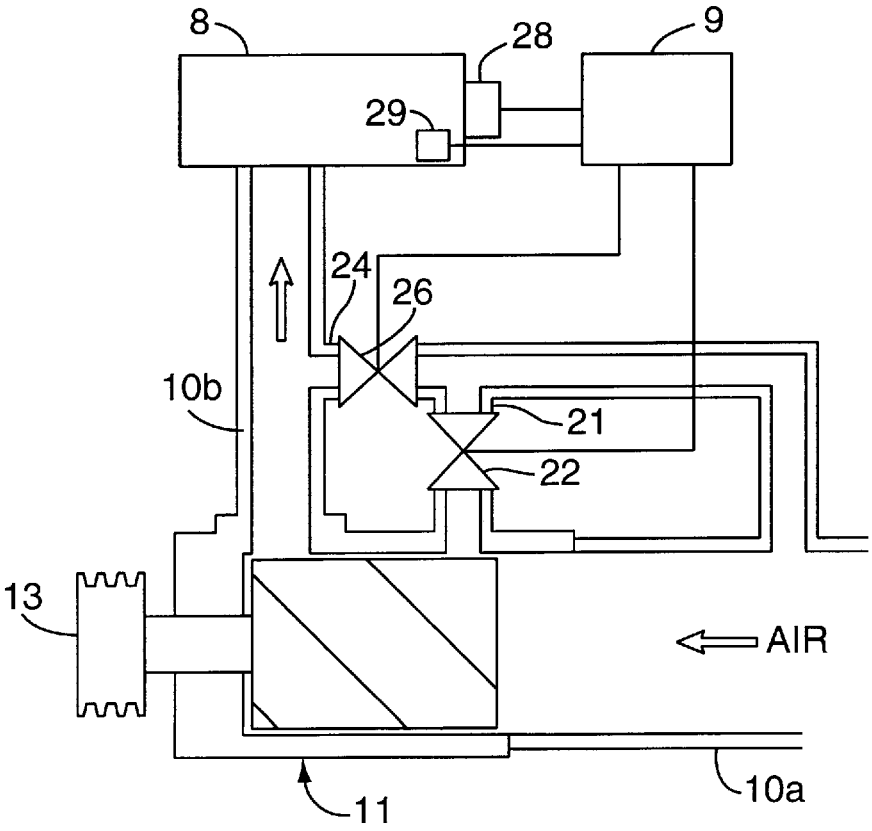
Figure 6:
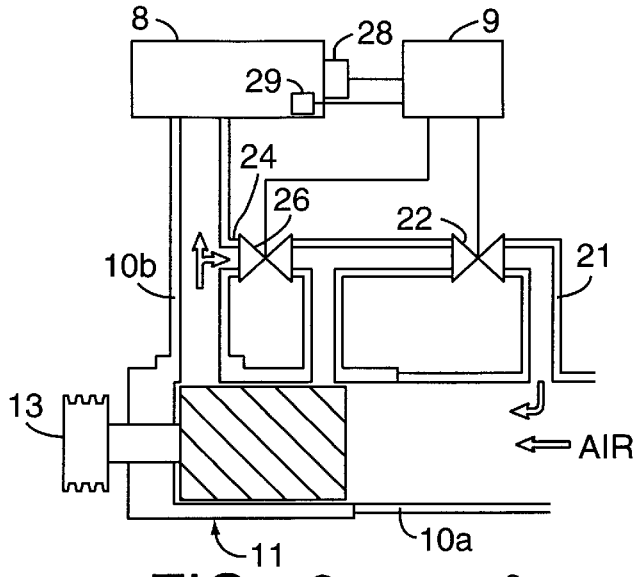
Figure 6A:
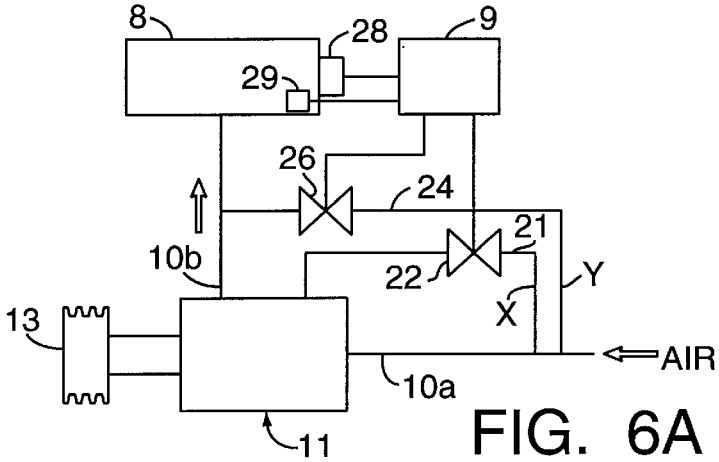
Figure 6B:
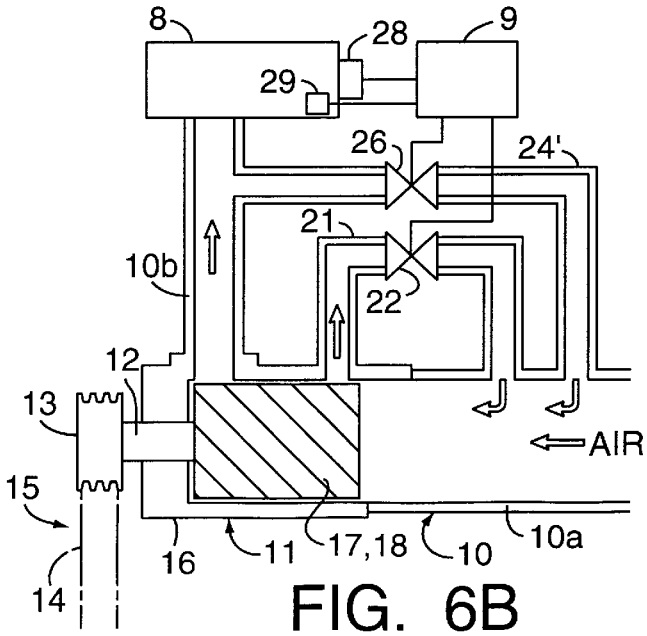

FIGS. 3A to 3C in combination illustrate the relationship between the engine, the screw supercharger and a duty solenoid valve when a vehicle equipped with the screw supercharger of the invention is operated in a normal manner; specifically, FIG. 3A is a diagram showing the relationship between an engine load and an engine revolution speed, FIG. 3B is a diagram showing the relationship between a supercharger load and a supercharger revolution speed, and FIG. 3C is a diagram showing the relationship between a duty ratio of the duty solenoid valve and the revolution speed of the supercharger and illustrates how the duty solenoid valve is controlled;

FIGS. 4A to 4D depict in combination optimization of an engine output, and specifically FIG. 4A depicts the maximum engine load without causing knocking relative to the engine revolution speed, FIG. 4B depicts a supercharger characteristic when a pressure ratio is maintained to be constant, FIG. 4C depicts a case where an amount of air to be supplied to the engine from the supercharger is designed to suit for a high speed condition, and FIG. 4D depicts a case where the amount of air to be supplied from the supercharger is designed to suit for a low speed condition;

FIG. 5 illustrates the relationship between the duty ratio of the duty solenoid valve (i.e., amount of air allowed to pass through the solenoid valve) and the engine revolution speed when the engine output is optimized;

FIG. 6 illustrates a schematic cross sectional view of a screw supercharger and associated parts of an engine according to a second embodiment of the present invention;

FIG. 6A diagrammatically illustrates two bypass passages formed in the screw supercharger arrangement shown in FIG. 6;

FIG. 6B illustrates a modification of the second embodiment of the present invention in cross section; and FIG. 7 illustrates a cross sectional view of a screw supercharger according to a third embodiment of the present invention.

Like numerals are assigned to like parts in different drawings.

DETAILED DESCRIPTION OF THE PREFERRED EMBODIMENTS

Now, a preferred embodiment of the present invention will be described with reference to the accompanying drawings.

Figure 1:
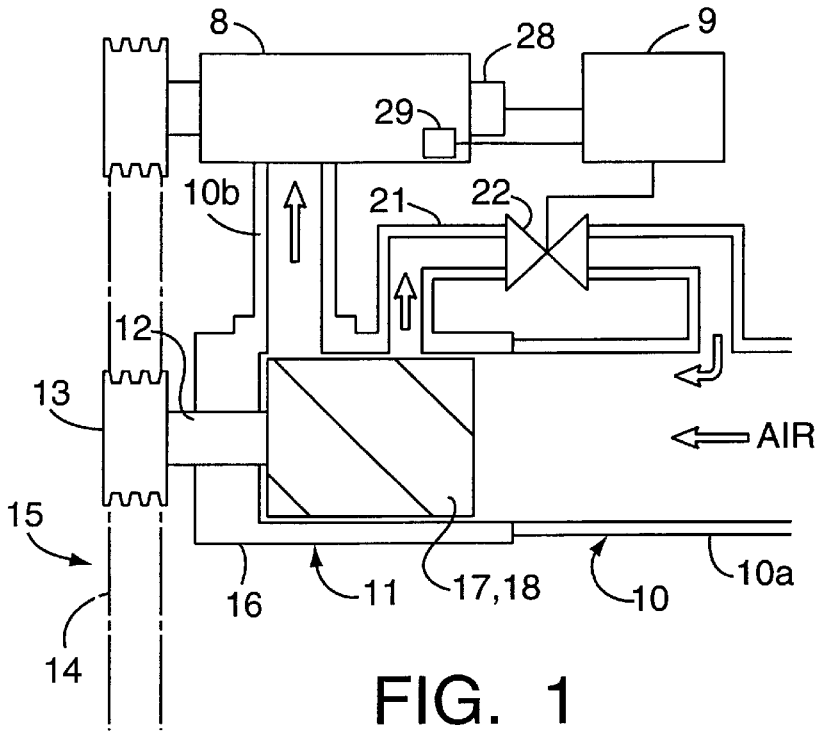
FIG. 1 illustrates a schematic sectional view of a screw supercharger and associated parts of an engine according to the present invention.

Referring to FIG. 1, an engine 8 of an automobile or the like has an intake air pipe 10 and a screw supercharger 11 connected to the intake air pipe 10. The screw supercharger 11 compresses an intake air to supply a compressed air to the engine 8. A shaft 12 of the screw supercharger 11 is connected to a crankshaft of the engine by a connection mechanism 15 including a pulley 13 and a belt 14.

Figure 2:
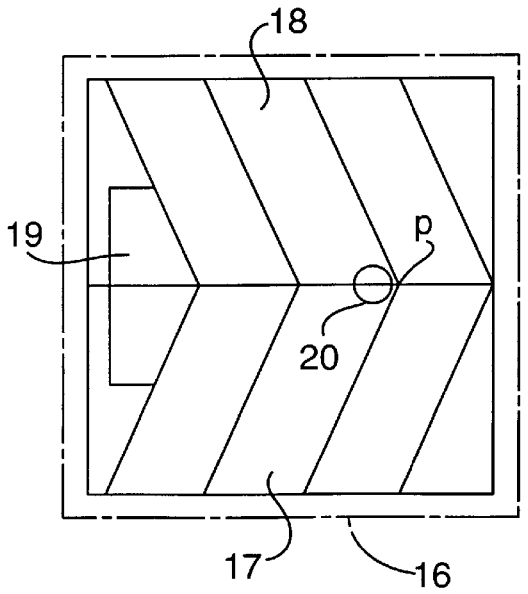
FIG. 2 illustrates a schematic plan view of rotors of the screw supercharger shown in FIG. 1.

Referring also to FIG. 2, the screw supercharger 11 has a casing 16 and a pair of male and female screw rotors 17 and 18 engaged with each other. The screw rotors 17 and 18 cooperatively rotate in the casing 16 to compress an intake air entering from an upstream pipe segment 10*a* of the intake air pipe 10, and eventually discharge a compressed air to a downstream pipe segment 10*b*. The downstream pipe segment 10*b* extends from an outlet 19 of the supercharger 11 toward the engine.

The screw supercharger 11 also has an intermediate opening 20 at a position slightly spaced leftward from a compression start point "p" of the supercharger 11. The supercharger 11 performs suction and compression inside the casing 16. Suction is necessary to introduce the intake air into the casing 16 from the upstream intake air pipe 10a and compression is necessary to supply a compressed air to the engine via the downstream air pipe 10*b*. Inside the supercharger 11, therefore, the air pressure increases from its inlet to outlet and there is a compression start point "p". The right side of the point "p" is a suction area.

A bypass pipe 21 extends from the recirculation opening 20 to the upstream intake air pipe 10*a*, and a duty solenoid valve 22 is provided on the bypass pipe 21 for arbitrarily adjusting an air flow rate of the compressed air to be returned to the inlet of the supercharger 11.

It is possible to change a duty ratio of the duty solenoid valve 22 between 0% (fully closed) and 100% (always opened). The flow rate of the air allowed to pass the solenoid valve 22 varies in proportion to the duty ratio of the solenoid valve 22.

There is provided a controller 9 to control the engine, and the duty ratio of the solenoid valve 22 is determined by this controller 9 according to a load of the engine as represented by one or more engine running condition signals produced by one or more engine running condition sensors 29. Thus, the amount of air to be recirculated to the upstream pipe segment 10*a* is adjusted by the controller 9 based on the running condition of the vehicle.

Fine control of the duty solenoid valve 22 is feasible using an electric signal and/or frequency adjustment.

In this particular embodiment, the screw supercharger 11 is originally designed to suit for a low speed condition of the engine. In other words, the amount of the supercharged air to be supplied from the supercharger 11 matches the low speed condition of the engine. In this case, an excessive amount of air tends to be supplied to the engine when the engine revolution speed becomes higher. However, the supercharger arrangement of this invention has the bypass pipe 21 so that the amount of air to be supplied to the engine from the supercharger 11 is controllable (reducible) by recirculating part of the intake air to the upstream intake air pipe 10*a*. The duty solenoid valve 22 is adjusted such that an appropriate amount of air is also supplied to the engine when the engine revolution speed is high. In sum, although the supercharger is originally designed to match the low speed condition, the amount of supercharged air to be supplied to the engine is always adjusted to be an appropriate value by combination of the bypass pipe 21 and duty solenoid valve 22 regardless of the engine revolution speed.

Now, an operation of the illustrated embodiment will be described.

As the engine 8 is operated, the screw supercharger 11 is driven by the power transmission mechanism 15 so that an intake air flowing from the upstream air pipe 10*a* is compressed between the male and female rotors 17 and 18 of the supercharger 11 and the compressed air is fed to the engine from the supercharger 11 through the downstream air pipe 10*b*.

It should be assumed here that the engine is operated in a normal manner in the following way: idling→acceleration→constant speed→deceleration→idling.

FIG. 3A shows relationship between an engine load and an engine rotational speed when the vehicle is operated in the normal manner as mentioned above. In this drawing, the black dot "a" indicates the idling condition, the white dot "b" indicates the constant speed driving condition, and the curve "c" indicates the engine load. As understood from FIG. 3A, the engine load increases as the vehicle is accelerated from the idling condition "a" until it reaches a peak point. The engine load then decreases gradually until the constant speed driving point "b" while the engine revolution speed is also increasing. A range from the idling point "a" to the maximum engine load point is referred to a full load condition area, and a range from the maximum engine load point to the constant speed point "b" is referred to as a partial load condition area and indicated by "d".

FIG. 3B illustrates the supercharger load relative to the supercharger revolution speed when the engine is operated in the above mentioned ordinary manner. The supercharger load is basically determined by the air flow rate at the exit of the supercharger 11. The curve "e" indicates a case where the amount of air (air flow rate) to be supplied to the engine is controlled to an optimum value. If the amount of air to be supplied to the engine is not controlled, the supercharger load takes a certain value in a shaded area "f" above the curve "e". This means that the supercharger 11 requires an additional work or energy if the air to be supplied to the engine from the supercharger 11 is not adjusted. The point "a" represents the idling and the point "b" represents the constant speed driving, which is the same as FIG. 3A.

FIG. 3C illustrates a duty ratio of the duty solenoid valve 22 relative to the revolution speed of the supercharger 11. The duty solenoid valve 22 is controlled according to this diagram in this particular embodiment.

In a certain period during acceleration from the idling condition "a" (or during the full load condition), the duty ratio drops to 0% from 100%. After this period (or during the partial load condition), the duty ratio gradually increases as indicated by the curve "g" until the acceleration is finished and the vehicle is brought into the constant speed condition "b". When the vehicle returns to the idling condition "a" from the point "b", the duty ratio is raised to 100% as indicated by the curve "h". The solenoid valve 22 is closed when its duty ratio is 0% and is always opened when 100%. As understood from FIG. 3C, if the amount of air to be supplied to the engine from the supercharger is not controlled, i.e., if the duty ratio of the solenoid valve 22 is maintained to be 0% from the idling condition "a" to the constant speed condition "b", the air of the shaded area "i" is excessively supplied to the engine. In this embodiment, the shaded area "i" is dispensed with by feeding back the air to the upstream intake air pipe 10*a*.

Engine running condition signals used to control the duty ratio of the duty solenoid valve 22 may be:

(a) a signal indicating an inclination angle of an accelerator pedal pedaled by a driver of a vehicle or an opening degree of an accelerator in a carburetor (The duty ratio is set to zero while the driver is pedaling the accelerator pedal during the full load range. Both when the engine load condition enters the partial load range (area "d" of FIG. 3A) and when reaches a constant speed condition, then the duty ratio is adjusted according to the opening degree of the accelerator);

(b) a signal indicating an air flow rate at the supercharger exit (This signal may be acquired from an air flow meter provided at the supercharger exit or on the intake air between the engine and supercharger. In case of gasoline engine, basically the air flow rate= supercharger load×supercharger revolution speed.);

(c) a signal indicating an engine revolution speed (An ordinary engine is equipped with an engine revolution speed sensor and a signal from the engine speed sensor is originally used for engine control. However, the supercharger revolution speed is acquired from this signal since the supercharger is rotated by the engine via the pulley-belt mechanism with a fixed ratio.); and (d) other signals indicating, for example, a shift lever position (low, second, third, drive, neutral, reverse, etc.), an engine water temperature, activation of a self starting motor (sel-motor), on/off of a clutch between the engine and a transmission (These signals may be additional signals which improve accuracy of the control in addition to the above signals (a) to (c). For instance, the duty solenoid valve is closed (duty ratio is 0%) when the engine is started. When the vehicle is stopped and the driver does not pedal a clutch pedal, the duty ratio of the solenoid valve is raised to 100%).

If the duty ratio of the duty solenoid valve 22 is controlled in the above described manner, a lost work or wasted work of the supercharger under the partial load condition (area "d" of FIG. 3A) during the normal driving is reduced.

Next, optimization of the engine output (engine torque) will be described with reference to FIGS. 4A, 4B, 4C, 4D and 5.

Generally, the engine does not demonstrate its maximum theoretical output in an actual driving. An actual upper limit of the engine output is lower than a theoretical value due to knocking in case of gasoline engine equipped with a supercharger.

The maximum output of the engine without causing knocking varies with a running condition of the engine, but it is generally determined by the intake air temperature (or the supercharger exit temperature) and the intake air pressure.

It should be assumed here that the engine maximum output without causing knocking draws a curve "j" as shown in FIG. 4A in relation to the engine revolution speed. If the pressure ratio is maintained constant, the relationship between the supercharger revolution speed and the air flow rate per one revolution of the supercharger draws a curve "k" as illustrated in FIG. 4B. If the supercharger characteristics are designed not to cause knocking under the high speed condition, the engine load relative to the engine revolution speed has relationship as illustrated in FIG. 4C. In FIG. 4C, the curve "j" indicates the knocking limitation and the curve "k" indicates the supercharger characteristic when the supercharger is designed to match the high speed condition (the curve "j" meets the curve "k" at the right end). As seen in FIG. 4C, the engine can demonstrate its possible maximum output when it is operated at a high speed but cannot when it is operated at a slower speed. The maximum engine output ("k") under the low speed condition is considerably below the knocking limitation "j". The shaded area "l" is an area in which the engine output is possibly raised. However, certain measures in addition to the supercharger 11 should be taken to raise the engine output toward the curve "j". Therefore, this supercharger setting is not preferable.

FIG. 4D illustrates a case where the supercharger has a characteristic curve "k" not to cause knocking under the low speed condition, i.e., the supercharger is designed to match the low speed condition (the curve "k" meets the curve "j" at the left end). Therefore, the engine demonstrates the possible maximum output when it is operated at the low speed. When the engine is operated at a high speed, however, an excessive amount of air tends to be supplied to the engine. To avoid such a undesired situation, some of the air compressed in the supercharger 11 is returned to the supercharge inlet by the bypass line 21 in the present invention. If the intake air is returned to the supercharger inlet from the supercharger body, the supercharger characteristic curve "k" is shifted downward as indicated by the arrows in FIG. 4D. In other words, the shaded area (over air feeding area) "m" can be eliminated in the invention. Accordingly, the supercharger can assist the engine such that the engine can demonstrate the possible maximum output under both the low and high speed conditions. The intake air is returned to the. upstream intake air pipe 10*a* when it is slightly compressed by the supercharger 11. Therefore, the recirculated intake air does not have a high temperature. As a result, it is possible to prevent elevation of the intake air temperature. Thus, an intercooler is not needed, unlike a conventional arrangement.

FIG. 5 illustrates the relationship between the duty ratio of the solenoid valve 22 and the engine revolution speed. The duty solenoid valve 22 is controlled according to the curve "n" in the present invention. If a simple ON-OFF valve is employed instead of the duty solenoid valve, the engine output changes stepwise as indicated by the dotted line "o". This is undesirable. Also, knocking likely occurs so that the engine operation may be disabled. In the invention, on the other hand, the duty solenoid valve 22 is employed and its duty ratio is adjusted according to the control curve "n" so as to appropriately control the flow rate of the air to be supplied to the engine from the supercharger. By such control, occurrence of knocking is prevented and the engine output changes smoothly in accordance with a running condition of the vehicle.

As mentioned above, the signals from the engine revolution sensor, air flow meter, accelerator sensor, etc. are used in controlling the duty solenoid valve 22. However, the knocking limitation changes with various reasons such as an atmospheric temperature and a kind of fuel (octane number). Thus, it is preferred to provide the engine with a knocking sensor 28 and control the duty solenoid valve 22 to have a larger duty ratio if occurrence of knocking is sensed by the knocking sensor.

The screw supercharger arrangement is disclosed in Japanese Patent Application No. 9-127371 filed May 16, 1997 and the entire disclosure thereof is herein incorporated by reference.

Referring to FIG. 6, illustrated is a second embodiment of the present invention. Like numerals are assigned to like parts in FIGS. 1 and 6, and description of such parts may be omitted below.

In this embodiment, a second bypass passage 24 is provided extending from the downstream intake air pipe 10*b* to the upstream intake air pipe 10*a* in addition to the first bypass passage 21 connecting the screw supercharger 11 to the upstream intake air pipe 10*a*. A second valve 26 is provided in the second bypass passage 24 for regulating a flow rate of air allowed to be recirculated to the upstream intake air pipe 10*a* from the downstream intake air pipe 10*b*. In the illustrated construction, it should be noted that part of the first bypass line 21 serves part of the second bypass line 24 (i.e., the second bypass line 24 merges into the first bypass line 21). The second valve 26 is located in the second bypass line 24 before the second bypass line 24 joins to the first bypass line 21.

By opening the first and second valves 22 and 26, the air is bypassed to the upstream intake air pipe 10*a* from the screw supercharger body 11 and from the downstream air intake pipe 10*b*. As illustrated in FIG. 6A, therefore, two bypass lines X and Y are formed in this embodiment.

In FIG. 6, since part of the first bypass line 21 is part of the second bypass line 24, piping is simplified (two separate pipes are not needed).

Opening/closing operations of the first and second bypass valves 22 and 26 may be performed in the following manner.

(1) The first bypass valve 22 opened and the second bypass valve 26 closed.

(2) The first and second bypass valves 22 and 26 both opened.

(3) The first valve 22 closed and the second valve 26 opened.

(4) The first and second bypass valves 22 and 26 both closed.

In the case of (1), the intake air is returned to the upper intake air pipe 10*a* from the screw supercharger 11 only. This is the same as the first embodiment.

In the case of (2), the two bypass lines 21 and 24 are opened. Consequently, the intake air is returned to the upstream intake air pipe 10*a* not only from the supercharger 11 but also from the downstream air intake pipe 10*b*. The amount of the recirculated air is the maximum in this case. In other words, the work needed to drive the supercharger is the minimum. When air recirculation via the first bypass passage 21 does not sufficiently reduces a wasted work of the screw supercharger 11, the second bypass passage 24 is then opened to further reduce the wasted work of the screw supercharger 11.

In the case of (3), the second bypass passage 24 is only opened. Since the first valve 22 is located in the first bypass passage 21 after the second bypass passage 24 merges into the first bypass passage 21, the intake air from the downstream intake air pipe 10*b* is not introduced to the upstream intake air pipe 10*a*. The intake air is supplied to the screw supercharger 11 from the downstream air pipe 10*b*. This bypassing way is used when positively elevating the engine intake air temperature. For instance, (3) is employed to make a catalyst reactive soon after the engine is first turned on (i.e., when the engine is cold).

In the case of (4), both of the bypass passages are closed. This valve setting is utilized when the engine is operated in a full load condition (i.e., when the engine requires the maximum supercharging).

It should be noted that the second bypass passage 24' may be completely separated from the first bypass passage 21 as depicted in FIG. 6B.

FIG. 7 illustrates a third embodiment of the present invention. Like numerals are assigned to like parts in FIGS. 1, 6 and 7, and such parts may not be described in detail below.

The supercharger arrangement of this embodiment is similar to that shown in FIG. 6, but location of the first valve 22 of the first bypass passage 21 is different. Specifically, the first valve 22 is provided in the first bypass passage 21 before the second bypass passage 24 merges into the first bypass passage 21. Therefore, when the first bypass valve 22 is closed, the intake air is not introduced to the supercharger 11.

Opening/closing operations of the first and second bypass valves 22 and 26 may be performed in the following manner.

(1') The first bypass valve 22 opened and the second bypass valve 26 closed.

(2') Both the first and second bypass valves 22 and 26 opened.

(3') The first valve 22 closed and the second valve 26 opened.

(4') Both the first and second bypass valves 22 and 26 closed.

In the case of (1'), the intake air is returned to the upper intake air pipe 10*a* from the screw supercharger 11 only. This is the same as the first embodiment.

In the case of (2'), the two bypass lines 21 and 24 are both opened. Consequently, the intake air is returned to the upstream intake air pipe 10*a* not only from the supercharger 11 but also from the downstream air intake pipe 10*b*. The amount of the recirculated air is the maximum in this case. In other words, the work needed to drive the supercharger is the minimum. When air recirculation via the first bypass passage 21 does not sufficiently reduces a wasted work of the screw supercharger 11, the second bypass passage 24 is then opened to further reduce the wasted work of the screw supercharger 11.

In the case of (3'), the second bypass passage 24 is only opened. Since the first bypass valve 22 closes the way to the supercharger 11, the intake air from the downstream intake air pipe 10*b* is not introduced to the supercharger 11 but to the upstream intake air pipe 10*a*. This bypassing way is also used when positively elevating the engine intake air temperature. For instance, (3') is employed to make a catalyst reactive soon after the engine is first turned on.

In the case of (4'), both of the bypass passages are closed. This valve setting is utilized when the engine is operated in a full load condition (i.e., when the engine requires the maximum supercharging).

It should be noted that the present invention is not limited to the illustrated embodiments and various modifications and changes may be made without departing from a spirit and scope of the present invention. For example, any suitable valve such as a valve having a stepping motor may be employed instead of the duty solenoid valve 22/26 as long as the valve can change the flow rate of the air passing therethrough.

What is claimed is:

1. A supercharger arrangement for a vehicle engine comprising:

a vehicle engine;

a supercharger having a main body with an inlet, an outlet and an intermediate opening for compressing an intake air introduced therein from the inlet, with an upstream intake air pipe extending to the inlet of the supercharger to introduce the intake air in the supercharger and a downstream intake air pipe extending to the engine from the outlet of the supercharger to supply a compressed air to the engine;

a first bypass pipe extending from the intermediate opening of the main body of the supercharger to the upstream intake air pipe such that part of the intake air compressed to a certain extent in the supercharger returns to the inlet of the supercharger;

a first valve connected to the first bypass pipe for controlling a flow rate of the air returning to the inlet of the supercharger through the first bypass pipe;

a second bypass pipe extending from the downstream intake air pipe to the upstream intake air pipe so that part of the intake air discharged from the outlet of the supercharger can be returned to the inlet of the supercharger; and a second valve connected to the second bypass pipe for controlling a flow rate of the air returning to the inlet of the supercharger through the second bypass pipe.

2. The supercharger arrangement of claim 1, wherein the intermediate opening is formed at a position of the supercharger at which the air moving through the supercharger has a positive pressure.

3. The supercharger arrangement of claim 2, wherein the supercharger is originally designed to feed such an amount of the intake air to the engine that the engine demonstrates a maximum output without causing knocking when the engine is running at a low speed.

4. The supercharger arrangement of claim 1, wherein the intermediate opening is formed at a position of the supercharger at which the air moving through the supercharger has a pressure higher than that of the air flowing in the upstream intake air pipe.

5. The supercharger arrangement of claim 4, wherein the supercharger is originally designed to feed such an amount of the intake air to the engine that the engine demonstrates a maximum output without causing knocking when the engine is running at a low speed.

6. The supercharger arrangement of claim 1, wherein the supercharger is originally designed to feed such an amount of the intake air to the engine that the engine demonstrates a maximum output without causing knocking when the engine is running at a low speed.

7. The supercharger arrangement of claim 1, wherein the intermediate opening is positioned relatively closer to the supercharger inlet rather than the outlet.

8. The supercharger arrangement of claim 1, wherein the supercharger is a screw supercharger.

9. The supercharger arrangement of claim 1, wherein the first valve is a duty solenoid valve.

10. The supercharger arrangement of claim 9, further comprising:

an engine running condition sensor; and a controller responsive to running condition signals produced by the running condition sensor, and wherein a duty ratio of the duty solenoid valve is changed by said controller between 0% and 100% according to said running condition a signals.

11. The supercharger arrangement of claim 10, wherein the duty ratio of the duty solenoid valve is 100% when the engine is operated in an idling condition.

12. The supercharger arrangement of claim 10 further including a knocking sensor, and wherein the duty ratio of the duty solenoid valve is raised by said controller if occurrence of knocking is sensed by the knocking sensor.

13. The supercharger arrangement of claim 9, wherein the duty solenoid valve adjusts the flow rate of the air returning to the inlet of the supercharger through the first bypass pipe in proportion to its duty ratio.

14. The supercharger arrangement of claim 9, further including a control means for adjusting said duty solenoid valve to a duty ratio of 0% when the engine load increases while the engine revolution rate is being raised.

15. The supercharger arrangement of claim 9, further including a control means for gradually increasing the duty ratio of the duty solenoid valve to correspondingly raise the flow rate of the air recirculated to the inlet of the supercharger through the first bypass pipe when the engine load drops while the engine revolution rate is being raised.

16. The supercharger arrangement of claim 9, further including control means for switching the duty ratio of the first valve to 100% to recirculate the air to the inlet of the supercharger through the first bypass pipe when the engine revolution rate is lowered from a constant rate condition.

17. The supercharger arrangement of claim 9, further including control means for controlling the duty ratio of the duty solenoid valve according to inclination of an accelerator pedal pedaled by a driver of a vehicle, an air flow rate at the exit of the supercharger, an engine revolution speed, a supercharger revolution speed, a shift position, a water temperature and/or activation of a self-starting motor of the engine.

18. The supercharger arrangement of claim 1, further comprising:

control means for opening the first valve when the engine is operated in an idling condition.

19. The supercharger arrangement of claim 1, wherein the engine is not equipped with an intercooler.

20. The supercharger arrangement of claim 1 further including a knocking sensor, and control means for opening the first valve more if occurrence of knocking is sensed by the knocking sensor.

21. The supercharger arrangement of claim 1, further including a control means for causing the first valve to adjust the flow rate of the air returning to the inlet of the supercharger through the first bypass pipe such that the supercharger does not perform a wasted work when the engine load drops while the engine revolution rate is being raised.

22. The supercharger arrangement of claim 1, further including a control means for closing the first valve when the engine load increases while the engine revolution rate is being raised.

23. The supercharger arrangement of claim 1, further including a control means for gradually opening the first valve to correspondingly raise the flow rate of the air recirculated to the inlet of the supercharger through the first bypass pipe when the engine load drops while the engine revolution rate is being raised.

24. The supercharger arrangement of claim 1, further including a means for fully opening the first valve to recirculate the air to the inlet of the supercharger through the first bypass pipe when the engine revolution rate is lowered from a constant rate condition.

25. The supercharger arrangement of claim 1, further including control means for controlling the opening degree of the first valve according to inclination of an accelerator pedal pedaled by a driver of a vehicle, an air flow rate at the exit of the supercharger, an engine revolution speed, a supercharger revolution speed, a shift position, a water temperature and/or activation of a self-starting motor of the engine.

26. The supercharger arrangement of claim 1, wherein the first valve is a valve having a stepping motor.

27. The supercharger arrangement of claim 1, wherein the second bypass pipe merges into the first bypass pipe.

28. The supercharger arrangement of claim 27, wherein the first bypass valve is located in the first bypass pipe after the second bypass pipe merges into the first bypass pipe.

29. The supercharger arrangement of claim 1, wherein the second bypass valve is a duty solenoid valve.

30. The supercharger arrangement of claim 1, wherein the second bypass valve is a valve having a stepping motor.

31. The supercharger arrangement of claim 1, further including a control means for closing the first bypass valve and for opening the second bypass valve upon starting up of the engine to hasten the process of making a catalyst reactive.

32. The supercharger arrangement of claim 1, further including a control means for opening the first and second bypass valves when the engine load decreases while the engine rotational rate is increasing further including a control means for opening.

33. The supercharger arrangement of claim 1, further including a control means for opening the first bypass valve when the engine load decreases while the engine rotational rate is increasing and for opening the second bypass valve if the engine load still decreases with increasing engine rotational rate after full opening of the first bypass valve.

34. The supercharger arrangement of claim 1, further including a control means for closing the first and second bypass valves when the engine load increases with increasing engine rotational rate so that no intake air is recirculated to the inlet of the supercharger.

35. The supercharger arrangement of claim 1, further including a control means for fully opening the first and second bypass valves when the engine rotational rate decreases following constant rotational rate running of the engine.

36. The supercharger arrangement of claim 1, further including a control means whereby the opening degree of the second bypass valve is controlled in accordance with inclination of an accelerator pedal pedaled by a driver of a vehicle, an air flow rate at the exit of the supercharger, an engine revolution speed, a supercharger revolution speed, a shift position, a water temperature and/or activation of a self-starting motor of the engine.

* * * * *

UNITED STATES PATENT AND TRADEMARK OFFICE

CERTIFICATE OF CORRECTION

PATENT NO. : 6,055,967
DATED : May 2, 2000
INVENTOR(S) : Yoshiyuki Miyagi et al.

It is certified that error appears in the above-identified patent and that said Letters Patent is hereby corrected as shown below:

Claim 10, line 8, please delete "a".

Signed and Sealed this

First Day of May, 2001

*Attest:*

Nicholas P. Godici

NICHOLAS P. GODICI

*Attesting Officer*

*Acting Director of the United States Patent and Trademark Office*